United States Patent [19]

Kennedy et al.

[11] Patent Number: 4,484,837

[45] Date of Patent: Nov. 27, 1984

[54] MINE STOPPING LAP-OVER PANEL CLAMP

[76] Inventors: John M. Kennedy; William R. Kennedy, both of P.O. Box 38, Taylorville, Ill. 62568

[21] Appl. No.: 512,361

[22] Filed: Jul. 11, 1983

[51] Int. Cl.[3] ..... E21D 9/00; E21F 1/00

[52] U.S. Cl. ..... 405/132; 52/484; 405/150

[58] Field of Search ..... 405/132, 150, 146, 303; 52/484, 486; 98/50; 24/171, 194, 652, 612

[56] References Cited

U.S. PATENT DOCUMENTS

| | | | |
|---|---|---|---|
| 2,729,064 | 4/1953 | Kennedy et al. | 405/150 |
| 3,302,343 | 2/1967 | Bear | 52/486 X |
| 3,608,159 | 9/1971 | Brucker | 24/612 |
| 3,630,554 | 12/1971 | Cherniak | 52/486 |
| 3,832,816 | 9/1974 | Jahn | 52/486 |
| 4,226,058 | 10/1980 | Riley | 52/486 X |

OTHER PUBLICATIONS

Jack Kennedy Metal Products & Buildings, Inc. *Metal Stopping Steel Man Doors*, brochure, p. 2, drawing of Std. Pkg. Stoppings.

*Primary Examiner*—Dennis L. Taylor

*Attorney, Agent, or Firm*—Senniger, Powers, Leavitt and Roedel

[57] ABSTRACT

A clamp for use in a mine stopping formed by a plurality of elongate extensible panels extending vertically from the floor to the roof of a passageway in a mine. The stopping comprises a series of main panels extending vertically side-by-side, with a space between two adjacent main panels, and a lap-over panel extending vertically and bridging the space. The clamp comprises a crosshead adapted to fit in the lap-over panel extending laterally of the lap-over panel and a hook-receiving stem slidable on the crosshead lengthwise of the crosshead. The slidable hook-receiving stem is formed to have hooks at the ends of a wire tie hooked thereto with the tie extending around a bar to draw the crosshead via the stem toward lips of the lap-over panel to clamp the latter in place.

3 Claims, 4 Drawing Figures

33
21
19
21
19
29
7
19
17
2
11
11
9
13
11
37
21
33
17
2
3
13
9
1
15
5
5
15
15
5
5
15

MINE STOPPING LAP-OVER PANEL CLAMP

BACKGROUND OF THE INVENTION

This invention relates to a clamp for clamping a lap-over panel in place in a mine stopping, and more particularly a clamp for clamping a lap-over panel in place off-center relative to a narrow space between two adjacent main panels of the stopping.

So-called mine "stoppings" are widely used in mines to stop off flow of air in passages in the mines, a stopping generally being installed at the entrance of a passage to block flow of air therethrough. One type of stopping which is widely used comprises a plurality of elongate sheet metal panels extending vertically in side-by-side relation from the floor to the roof of a passageway in a mine. A problem has been encountered with prior mine stoppings of this type in that a relatively large gap at the top or bottom of the stopping could not be blocked off by the use of a lap-over panel unless the panel could be centered with respect to the two adjacent panels. If this could not be done, a substantial opening was undesirably left at the roof or floor.

SUMMARY OF THE INVENTION

Among the several objects of this invention may be noted the provision of an improved lap-over panel clamp which allows a lap-over panel to be off-centered to block a gap at the roof or floor line of a mine stopping; and the provision of such a clamp which is simple in construction, economical to manufacture and easy to use.

In general, the clamp of this invention is for use in a mine stopping comprising a plurality of elongate extensible panels extending vertically from the floor to the roof of a passageway in a mine. Each panel is of channel shape in cross section thereby comprising a web and flanges at opposite sides of the web with inturned portions at the outer edges of the flanges, and lips at the inner edges of the inturned portions extending toward the web. The stopping comprises a series of the panels constituting main panels extending vertically side-by-side, with a space between two adjacent main panels, and a lap-over panel extending vertically and bridging the space with the inturned portions of its flanges engaging the webs of the two adjacent main panels. The stopping further comprises at least one bar extending substantially horizontally between ribs at opposite sides of the passageway engaging the inturned portions of the flanges of the main panels of the series and a plurality of U-shaped wire ties for securing the main panels to the bar. Each tie has a hook at each end hooked to the lips of the main panels. The tie extends around the bar and is twisted to draw the bar and main panels together. The clamp, which clamps the lap-over panel in place, comprises a crosshead adapted to fit in the lap-over panel extending laterally of the lap-over panel between its side flanges in engagement with the lips of the lap-over panel, and has end portions extending therefrom in the direction to extend into the spaces between the lips and the flanges of the lap-over panel toward the inturned portions of the flanges of the lap-over panel. A hook-receiving stem is slidable on the crosshead lengthwise of the crosshead and extends from the crosshead in the same direction as the end portions. The slidable hook-receiving stem is formed to have the hooks at the ends of a wire tie hooked thereto with the tie extending around the bar to draw the crosshead, via the stem, toward the lips of the lap-over panel.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
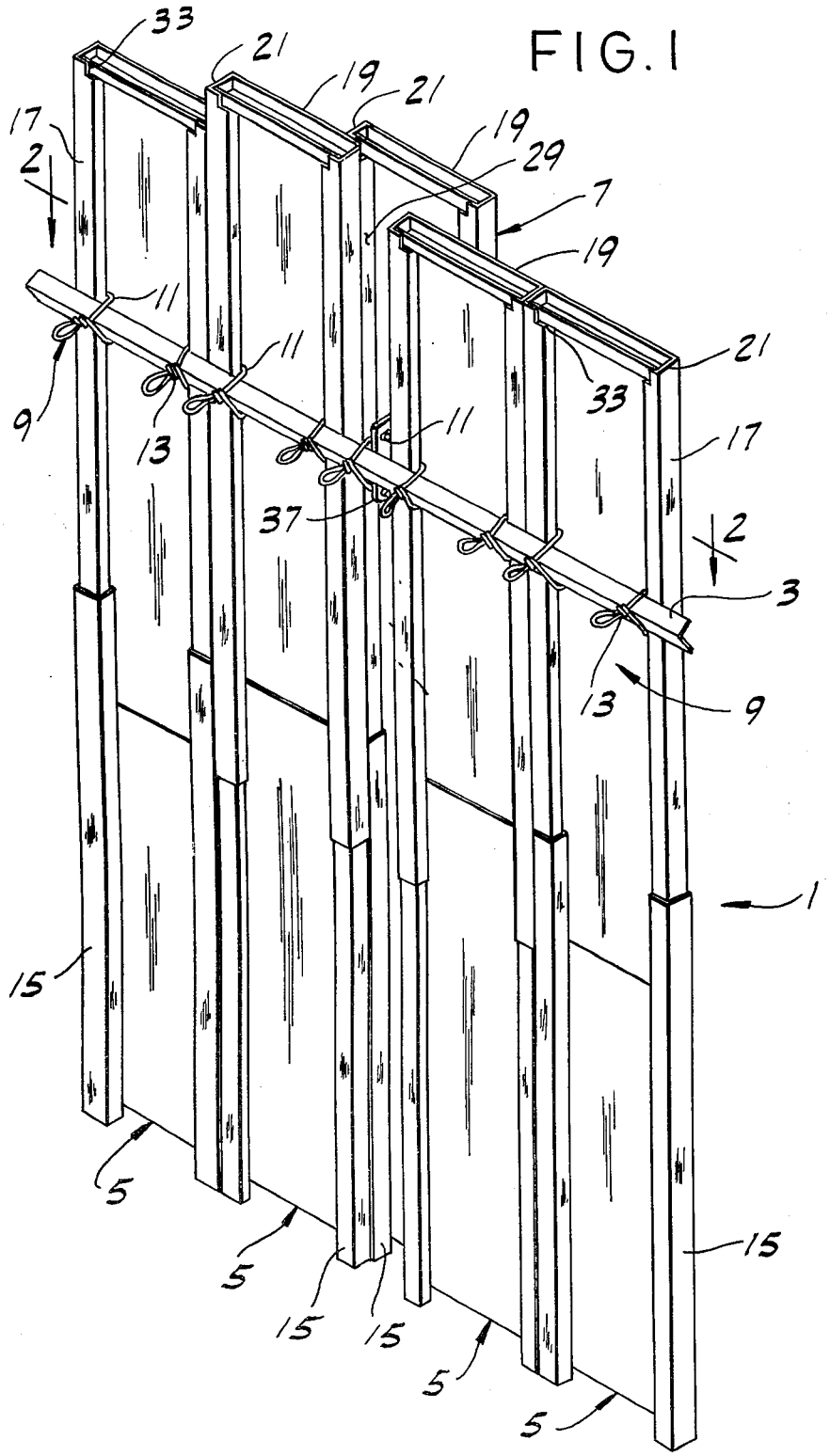
FIG. 1 is a perspective of a mine stopping with a lap-over panel and a clamp of this invention.

Referring to the drawings, there is generally indicated at 1 a mine stopping of this invention installed in passageway P in a mine comprising a bar 3 extending substantially horizontally between ribs R at opposite sides of the passageway, and a plurality of elongate extensible panels consisting of main panels 5 and a lap-over panel 7 which extend vertically from the floor to the roof of the passageway. A plurality of generally U-shaped wire ties 9 are provided to secure the main panels 5 to the bar 3, each tie having a hook 11 at each end engageable with one of the main panels 5 and a central portion 13 adapted to be twisted so as to deform the tie around the bar 3 and draw the bar and the main panels together.

Figure 4:
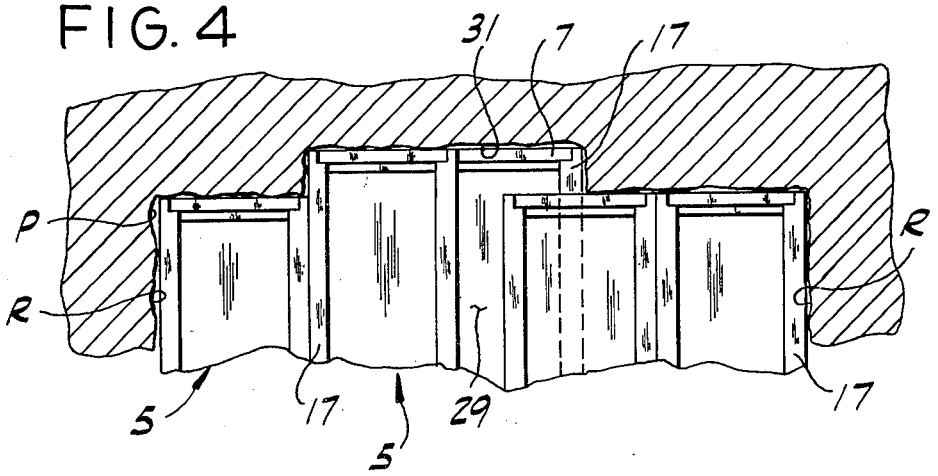
FIG. 4 is a top section of the mine stopping in a passageway of a mine with a main panel and a lap-over panel extended upward into a recess in the roof of the passageway.

Each of the panels 5 and 7 comprises a first elongate member 15 constituting a lower member of the panel adapted for engagement of its lower end with the floor of the passageway, and a second elongate member 17 constituting an upper member of the panel adapted for engagement of its upper end with the roof of the passageway P (as shown in FIG. 4). Each panel member 5 and 7 is a sheet metal member of channel shape in cross section having a web 19 and flanges each designated 21 at opposite sides of the web. Each flange 21 has an inturned portion 23 at its outer edge extending generally parallel to the web 19 and a lip 25 at the inner edge of the inturned portion extending toward the web 19. The upper panel member 17 has a telescoping fit in the respective lower panel member 15, the webs 19 of the members being in sliding engagement. (This could be reversed—the lower panel member 15 may have a telescoping sliding fit in the upper panel member 17.) The lips 25 of each upper panel member terminate short of the upper end of the upper member 17 thereby providing a notch 27 at the upper end of each lip of the upper panel member. Similarly, the lips of each lower panel member terminate short of the lower end of the lower member thereby providing a notch at the lower end of each lip of the lower panel member.

Figure 2:
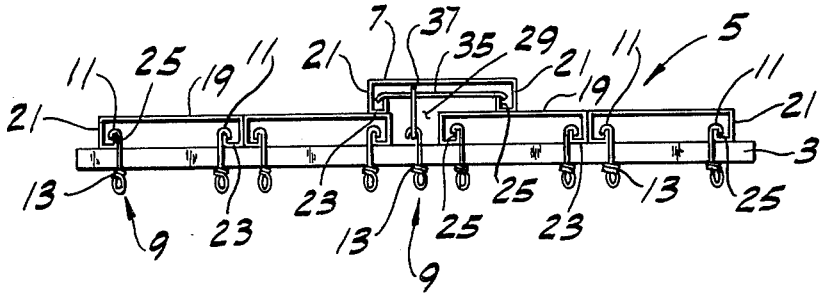
FIG. 2 is a horizontal section on line 2—2 of FIG. 1.

In some instances, the main panels 5 may be used to block the passageway of a mine by being placed in side-by-side contacting relationship across the passageway in the mine and extending upwardly to a substantially level roof. However, in many cases there will be a space 29 between two adjacent main panels 5 due to the width of the passageway being somewhat greater than the width of a certain number of panels but not enough for another panel to fit therein. In such a case, a lap-over panel 7 is needed to bridge the space 29. Additionally, there are also times when the roof has a recess 31 as seen in FIG. 4 requiring the upward extension of one or more main panels 5 beyond that of the other main panels, and in many such instances the dimension of the recess 31 in the roof transversely of the passageway is not a whole multiple of the main panel width. Similarly, the floor could have a recess therein necessitating the downward extention of one or more panels beyond that of the other main panels. Under such circumstances, a lap-over panel 7, offset from the space 29 between the two adjacent main panels 5, is utilized to block the recess or gap 31. This is illustrated in FIGS. 1, 2, and 4, panel 7 blocking space 29 while at the same time having its upper panel member 17 upwardly extended to block gap 31.

Figure 3:
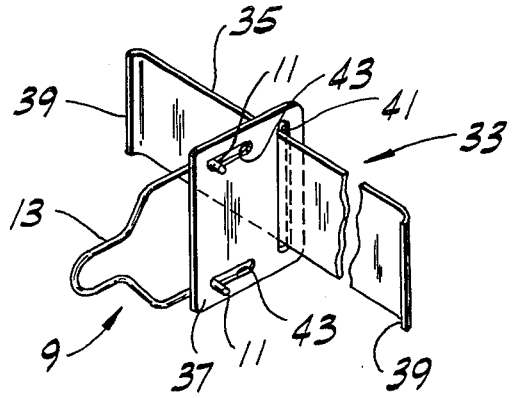
FIG. 3 is an enlarged perspective of a lap-over clamp of this invention.

A clamp 33 of this invention for clamping the lap-over panel in place is shown per se in FIG. 3. It comprises a crosshead 35 and a hook-receiving stem 37. As shown in FIG. 2, the crosshead fits in the lap-over panel 7 extending laterally of the lap-over panel between its side flanges 21 in engagement with the lips 25 of the lap-over panel and has end portions 39 exending therefrom in the direction to extend into the spaces between the lips 25 and the flanges 21 of the lap-over panel 7 toward the inturned portions 23 of the flanges of the lap-over panel. The hook-receiving stem 37 has a vertical slot 41 and two horizontal slots 43 therein (see FIG. 3). The crosshead 35 is inserted through the slot 41, the stem 37 being slidable on the crosshead lengthwise of the crosshead and extending from the crosshead 35 in the same direction as the end portions 39. The two slots 43 of the stem 37 receive the hooks 11 at the ends of a wire tie 9, the tie extending around the bar 3 and being twisted to draw the crosshead via the stem toward the lips of the lap-over panel. This results in the inturned portions 23 of the lap-over panel flanges being pressed into engagement with the webs 19 of the two adjacent main panels, as shown in FIGS. 1 and 2. It will be observed that the stem 37 may be slid on the crosshead 35 to whatever position of the stem 37 may be needed for the stem to extend through the space 29 with the lap-over panel 7 off-centered one way or the other from the space 29 within a relatively wide range.

In view of the above, it will be seen that the several objects of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. For use in a mine stopping comprising a plurality of elongate extensible panels extending vertically from the floor to the roof of a passageway in a mine, each panel being of channel shape in cross section thereby comprising a web and flanges at opposite sides of the web, and having inturned portions at the outer edges of the flanges, and lips at the inner edges of the inturned portions extending toward the web, said stopping comprising a series of said panels constituting main panels extending vertically side-by-side, with a space between two adjacent main panels, and further comprising one of said panels constituting a lap-over panel extending vertically and bridging said space with the inturned portions of its flanges engaging the webs of said two adjacent main panels, at least one bar extending substantially horizontally between ribs at opposite sides of the passageway engaging the inturned portions of the flanges of the main panels of said series, a plurality of U-shaped wire ties for securing the main panels to the bar, each tie having a hook at each end hooked to the lips of the main panels, the tie extending around the bar and being twisted to draw the bar and main panels together:

a clamp for clamping the lap-over panel in place with the inturned portions of its flanges engaging the outside of the web of the two adjacent main panels comprising a crosshead adapted to fit in the lap-over panel extending laterally of the lap-over panel between its side flanges in engagement with the lips of the lap-over panel and having end portions extending therefrom in the direction to extend into the spaces between the lips and the flanges of the lap-over panel toward the inturned portions of the flanges of the lap-over panel, a hook-receiving stem slidable on the crosshead lengthwise of the crosshead and extending from the crosshead in the same direction as said end portions, said slidable hook-receiving stem being formed to have the hooks at the ends of a wire tie hooked thereto with the tie extending around said bar to draw the crosshead via said stem toward the lips of the lap-over panel.

2. A clamp as set forth in claim 1 wherein said stem is slidable on the crosshead by having a slot therein receiving the crosshead.

3. A clamp as set forth in claim 2 wherein said stem has openings therein for receiving the hooks of the wire ties.

* * * * *